US009242494B2

(12) United States Patent
Nakamura

(10) Patent No.: US 9,242,494 B2
(45) Date of Patent: Jan. 26, 2016

(54) PRINTER AND PRINTING METHOD

(71) Applicant: Roland DG Corporation, Hamamatsu-shi, Shizuoka (JP)

(72) Inventor: Yasutoshi Nakamura, Hamamatsu (JP)

(73) Assignee: ROLAND DG CORPORATION, Shizuoka (JP)

( * ) Notice: Subject to any disclaimer, the term of this patent is extended or adjusted under 35 U.S.C. 154(b) by 0 days.

(21) Appl. No.: 14/615,590

(22) Filed: Feb. 6, 2015

(65) Prior Publication Data

US 2015/0224801 A1 Aug. 13, 2015

(30) Foreign Application Priority Data

Feb. 7, 2014 (JP) ..... 2014-022527

(51) Int. Cl.

| | |
|---|---|
| ***B41J 29/393*** | (2006.01) |
| ***B41J 3/28*** | (2006.01) |
| ***B41J 3/407*** | (2006.01) |
| ***B41J 11/00*** | (2006.01) |

(52) U.S. Cl.
CPC *B41J 29/393* (2013.01); *B41J 3/28* (2013.01); *B41J 3/407* (2013.01); *B41J 11/008* (2013.01)

(58) Field of Classification Search
CPC ..... B41J 29/393; B41J 29/38; B41J 11/0095; B41J 11/009
See application file for complete search history.

(56) References Cited

U.S. PATENT DOCUMENTS 7,497,542 B2 * 3/2009 Niioka ..... B41J 11/0095 347/19
7,591,521 B2 * 9/2009 Aruga ..... B41J 29/393 347/13
8,998,371 B2 * 4/2015 Nakano ..... B41J 11/0045 347/16
2012/0256995 A1 10/2012 Holzer et al.

FOREIGN PATENT DOCUMENTS

| | | | |
|---|---|---|---|
| EP | 1 839 884 | A1 | 10/2007 |
| EP | 2 508 347 | A1 | 10/2012 |
| EP | 2 803 492 | A1 | 11/2014 |
| JP | 2007-136764 | A | 6/2007 |
| JP | 4012200 | B2 | 11/2007 |

OTHER PUBLICATIONS

Official Communication issued in corresponding European Patent Application No. 15154161.2, mailed on Jun. 18, 2015.

* cited by examiner

*Primary Examiner* — Lamson Nguyen
(74) *Attorney, Agent, or Firm* — Keating and Bennett, LLP

(57) ABSTRACT

A printing device includes a location area acquirer that acquires a location area for a printing subject from a background image and a foreground image; a rough edge image acquirer that acquires a first edge image showing a rough contour of the printing subject; a precise edge image acquirer that acquires a second edge image showing a precise contour of the printing subject; a location position acquirer that acquires a position and a posture of the printing subject from the second edge image; a calculator that calculates, based on the position and the posture of the printing subject, a transform matrix usable to perform normalization such that the printing subject assumes a predetermined posture; and a printing data generator that creates printing data actually usable for printing, by use of an inverse matrix of the transform matrix, from printing data edited by an operator.

15 Claims, 12 Drawing Sheets

FIG.5A BACKGROUND IMAGE
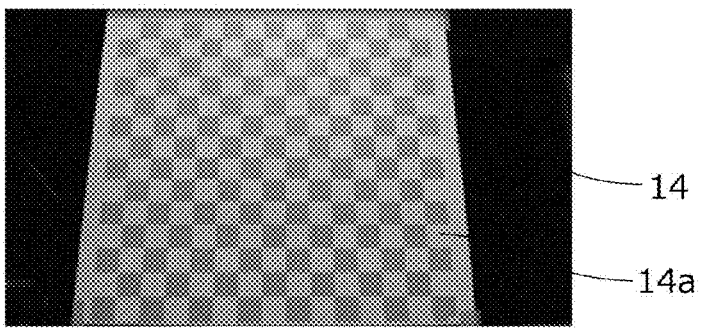
FIG.5B FOREGROUND IMAGE
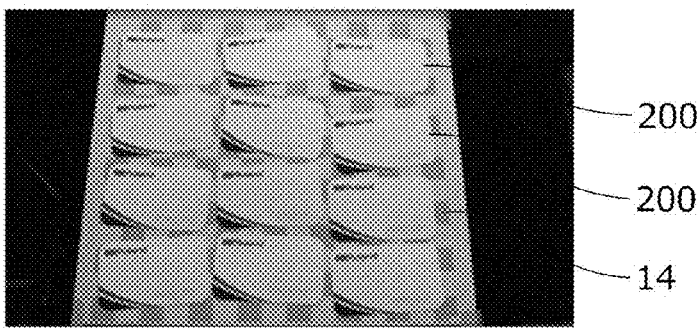
FIG.5C BACKGROUND IMAGE AFTER CORRECTION, ETC.
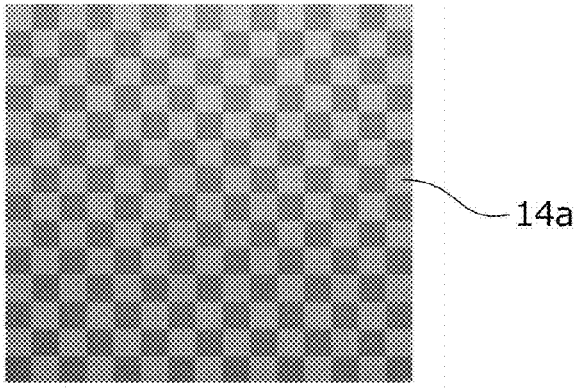
FIG.5D FOREGROUND IMAGE AFTER CORRECTION, ETC.
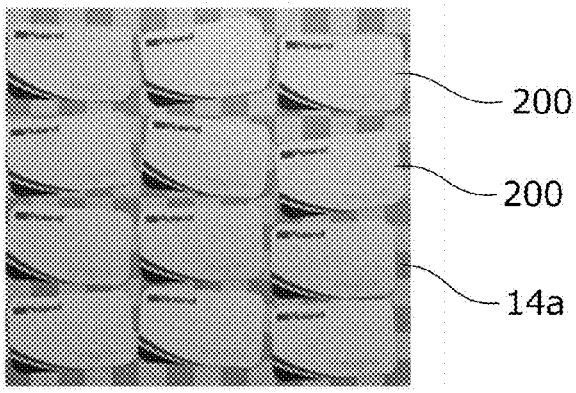

GRAY SCALE IMAGE

DIFFERENTIAL BINARY IMAGE

BACKGROUND BINARY IMAGE

ABSOLUTE DIFFERENTIAL IMAGE

ABSOLUTE DIFFERENTIAL IMAGE
DEPRIVED OF NOISE

EXTRACTION

POINT GROUP OF
WHITE PIXELS

BOUNDING BOX

EXPAND THE BOUNDING BOX BY 3 PIXELS

BLACK PIXELS

REMOVE THE BLACK PIXELS

EXPAND THE WHITE AREA BY 2 PIXELS OUTWARD

EXPANDED IMAGE

CONTRACT AND THEN INVERT WHITE AND BLACK

CONTRACTED AND INVERTED IMAGE

ROUGH EDGE IMAGE

FOREGROUND IMAGE
IN ACQUIRED ROI

NON-MAXIMAL SUPPRESSION
DoG IMAGE

PRECISE EDGE IMAGE

IMAGE DATA

EDITED PRINTING DATA

PRINTING DATA ACTUALLY USABLE FOR PRINTING

PRINTER AND PRINTING METHOD

The present application claims priority from Japanese Patent Application No. 2014-022527 filed on Feb. 7, 2014, which is incorporated by reference herein in its entirety.

BACKGROUND OF THE INVENTION

1. Field of the Invention

The present invention relates to a printing device and a printing method.

2. Description of the Related Art

Conventionally, so-called flatbed-type printing devices are known. In a flatbed-type printing device, a printing head is moved, for example, in two directions perpendicular to each other in a plane with respect to a printing subject placed on a table. Such a flatbed-type printing device is used for performing printing on, for example, a printing subject such as a substantially rectangular business card, greeting card or the like. In the following description, the term "printing subject" is a "substantially rectangular sheet-type or plate-type printing subject such as a substantially rectangular business card, greeting card or the like", unless otherwise specified.

For performing printing on a printing subject by use of a flatbed-type printing device, the printing subject is placed on a table and then printing is performed. For accurate printing, the printing subject needs to be placed precisely at a predetermined position. This requires, for example, measuring the size of the printing subject beforehand, so that the position at which the printing subject is to be placed is determined accurately.

Such a work needs to be performed accurately. For an unexperienced operator, the work is time-consuming. This causes a problem that the printing requires a long time and the production cost is raised. There is also a problem that the work requires a great number of steps to be performed by an operator, which imposes a heavy load on the operator.

A technology for solving these problems is proposed by, for example, Japanese Laid-Open Patent Publication No. 2007-136764. According to the technology disclosed in Japanese Laid-Open Patent Publication No. 2007-136764, a jig that can be secured to a table and accommodate a plurality of printing subjects at a fixed position is produced. For performing printing, the jig is secured to the table and a plurality of printing subjects are accommodated in the jig. The position in the jig at which each of the plurality of printing subjects is accommodated is predetermined. The position is input beforehand to a microcomputer that controls the printing device. This allows the position of each printing subject to be determined by the jig, so that printing is performed at predetermined positions of the printing subjects.

However, the above-described technology requires producing a jig in accordance with the shape or the size of a printing subject. This causes a problem that the production of a jig is time-consuming. In addition, even in the case where printing is to be performed on a small number of printing subjects, a jig needs to be produced. This causes a problem that in the case where printing is performed on a small number of printing subjects, the cost per printing subject is increased.

A conceivable measure for solving these problems is to acquire the position and the posture of the printing subject located on the table and determine the position at which the printing is performed based on the acquired information on the position and the posture. With this measure, the position and the posture of the printing subject may be acquired by extracting a difference between an image obtained when no printing subject is placed on the table and an image obtained when the printing subject is placed on the table. In other words, a so-called background subtraction method is usable. However, in the case where the table and the printing subject have similar colors or in the case where there is a shadow between the table and the printing subject, the background subtraction method does not provide the shape or the like of the printing subject accurately.

A technology for acquiring an accurate shape of an object (corresponding to the printing subject) by use of the background subtraction method is disclosed in, for example, Japanese Patent No. 4012200. According to this technology, a background image (corresponding to the image obtained when no printing subject is placed on the table) is captured at a plurality of time points, and the shape or the like of the object is acquired by use of the background images captured at the plurality of time points. However, this technology requires a great number of images having different levels of luminance since the luminance changes along with time. Use of such a great number of images requires a long time for image capturing and also a large memory capacity. A process of acquiring the position or the posture of the printing subject is also time-consuming. In addition, almost no ambient light is incident into the inside of the printing device. In such an environment where the luminance does not change almost at all, it is considered difficult to stably acquire the shape or the like of an object.

SUMMARY OF THE INVENTION

Preferred embodiments of the present invention provide a printing device and a printing method capable of performing printing stably at a desired position of a printing subject without the use of a jig.

A printing device according to a preferred embodiment of the present invention includes a table including a top surface on which one or a plurality of printing subjects having a rectangular or a substantially rectangular shape are to be placed; a printing head located above the top surface of the table, the printing head being movable with respect to the top surface of the table in an X-axis direction and a Y-axis direction, the X-axis direction and the Y-axis direction being perpendicular to a vertical axis; an image capturing device that captures an image of the top surface of the table; a location area acquirer that acquires a background image, captured by the image capturing device, of the top surface on which a checkered pattern is printed and no printing subject is placed and a foreground image, captured by the image capturing device, of the top surface on which the one or plurality of printing subjects are placed, and acquires a location area for each of the printing subjects from the background image and the foreground image; a rough edge image acquirer that acquires a first edge image showing a rough contour of each of the printing subjects in the location area acquired by the location area acquirer; a precise edge image acquirer that acquires, from the first edge image, a second edge image showing a precise contour of each of the printing subjects; a location position acquirer that acquires a position and a posture of each of the printing subjects from the second edge image; a calculator that calculates a transform matrix usable to normalize each of the printing subjects such that each of the printing subjects assumes a predetermined posture, the transform matrix being calculated based on the position and the posture of each of the printing subjects acquired by the location position acquirer; and a printing data generator that calculates an inverse matrix of the transform matrix calculated by the calculator and transforms, by use of the inverse matrix, printing data edited by an operator to create printing data actually usable for printing.

A printing method according to another preferred embodiment of the present invention is performed by a printing device including a table including a top surface on which one or a plurality of printing subjects having a rectangular or a substantially rectangular shape are to be placed; a printing head located above the top surface of the table, the printing head being movable with respect to the top surface of the table in an X-axis direction and a Y-axis direction, the X-axis direction and the Y-axis direction being perpendicular to a vertical axis; and an image capturing device that captures an image of the top surface of the table. The method includes acquiring a background image, captured by the image capturing device, of the top surface on which a checkered pattern is printed and no printing subject is placed and a foreground image, captured by the image capturing device, of the top surface on which the one or plurality of printing subjects are placed; acquiring a location area for each of the printing subjects from the background image and the foreground image; acquiring a first edge image showing a rough contour of each of the printing subjects in the location area acquired by the location area acquirer; acquiring, from the first edge image, a second edge image showing a precise contour of each of the printing subjects; acquiring a position and a posture of each of the printing subjects from the second edge image; calculating a transform matrix usable to normalize each of the printing subjects such that each of the printing subjects assumes a predetermined posture, the transform matrix being calculated based on the position and the posture of each of the printing subjects; calculating an inverse matrix of the transform matrix; and transforming, by use of the inverse matrix, printing data edited by an operator to create printing data actually usable for printing.

According to various preferred embodiments of the present invention, printing is stably performed at a desired position in a printing subject without the use of a jig.

The above and other elements, features, steps, characteristics and advantages of the present invention will become more apparent from the following detailed description of the preferred embodiments with reference to the attached drawings.

BRIEF DESCRIPTION OF THE DRAWINGS

FIG. 5A shows a background image captured by the camera, FIG. 5B shows a foreground image captured by the camera, FIG. 5C shows a background image obtained by lens distortion correction and projection transform to a printing area, and FIG. 5D shows a foreground image obtained by lens distortion correction and projection transform to the printing area.

FIG. 6D shows a background binary image acquired by binarizing the background image obtained by the correction and the like.

DETAILED DESCRIPTION OF THE PREFERRED EMBODIMENTS

Hereinafter, examples of preferred embodiments of a printing device and a printing method according to the present invention will be described in detail with reference to the attached drawings. In the figures, letters F, Re, L, R, U and D respectively represent front, rear, left, right, up and down. In the following description, the directions "front", "rear", "left", "right", "up" and "down" are provided for the sake of convenience, and do not limit the manner in which the printing device is installed in any way.

Figure 1:
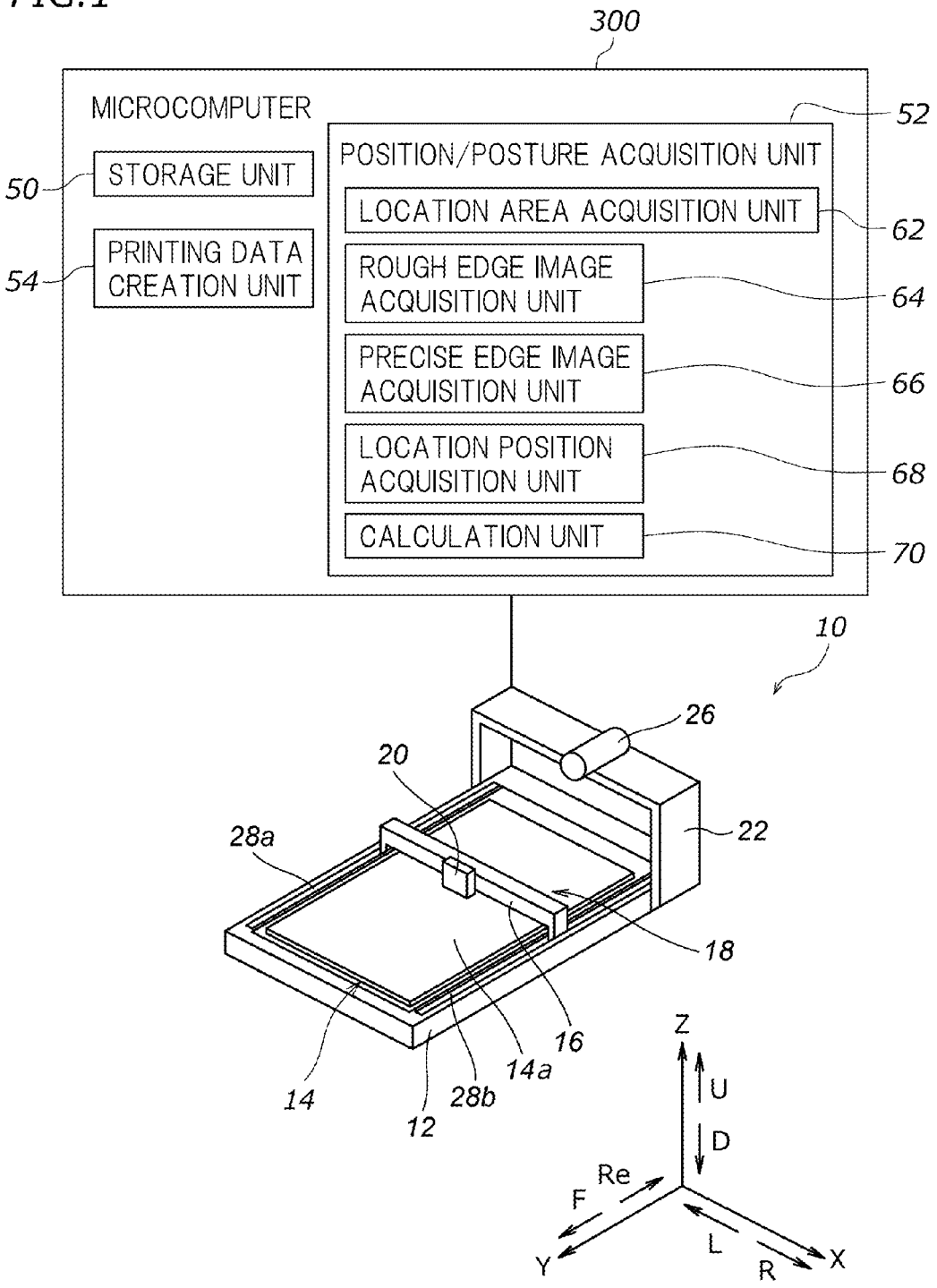
FIG. 1 shows a schematic structure of a printing device in a preferred embodiment according to the present invention.

First, a structure of a printing device 10 will be described. As shown in FIG. 1, the printing device 10 is a so-called flatbed-type inkjet printer. The printing device 10 includes a base member 12, a table 14 including a top surface 14*a*, a movable member 18 including a rod-shaped member 16, a printing head 20, a standing member 22 standing on a rear portion of the base member 12, and a camera 26.

Figure 2:
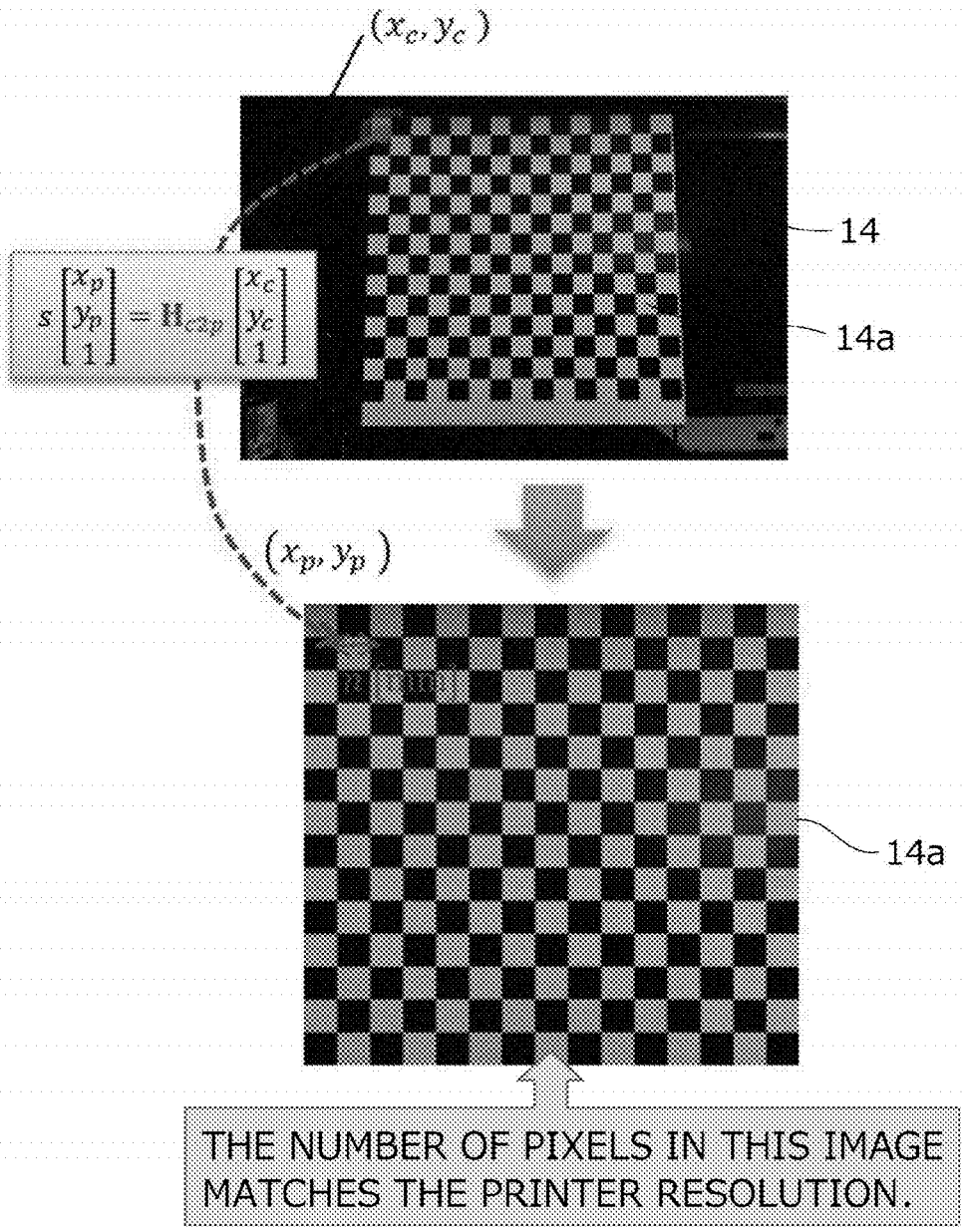
FIG. 2 shows that the square pitch of a checkered pattern captured by a camera is transformed into the number of pixels as the printer resolution, and the image captured by the camera is projection-transformed into a coordinate system based on the table.

The table 14 is located on the base member 12. The top surface 14*a* of the table 14 is flat. On the top surface 14*a*, a checkered pattern (see FIG. 2) is to be printed by the printing head 20. On the top surface 14*a*, a printing subject 200 (not shown in FIG. 1; see FIG. 5B) such as a rectangular or substantially rectangular business card, greeting card or the like is to be placed.

The base member 12 is provided with guide grooves 28*a* and 28*b* extending in a Y-axis direction. The movable member 18 is driven by a driving mechanism (not shown) to move in the Y-axis direction along the guide grooves 28*a* and 28*b*. There is no limitation on the driving mechanism that moves the movable member 18 in the Y-axis direction. The driving mechanism may be a known mechanism such as, for example, a combination of a gear and a motor. The rod-shaped member 16 extends in an X-axis direction above the table 14. A Z axis is a vertical axis, the X axis is perpendicular to the Z axis, and the Y axis is perpendicular to the X axis and the Z axis.

The printing head 20 is an ink head that injects ink by an inkjet system. In this specification, the "inkjet system" refers to a printing system of any of various types of conventionally known inkjet technologies. The "inkjet system" encompasses various types of continuous printing systems such as a binary deflection system, a continuous deflection system and the like, and various types of on-demand systems such as a thermal system, a piezoelectric element system and the like. The printing head 20 is structured to perform printing on the printing subject 200 placed on the table 14. The printing head 20 is provided on the rod-shaped member 16. The printing head 20 is provided so as to be movable in the X-axis direction. This will be described in more detail. The printing head 20 is engaged with guide rails (not shown) provided on a front surface of the rod-shaped member 16 and is slidable with respect to the guide rails. The printing head 20 is provided with a belt (not shown) movable in the X-axis direction. The belt is rolled up by a driving mechanism (not shown) and thus is moved. Along with the movement of the belt, the printing head 20 moves in the X-axis direction from left to right or from right to left. There is no limitation on the driving mechanism. The driving mechanism may be a known mechanism such as, for example, a combination of a gear and a motor.

The camera 26 is secured to the standing member 22. The camera 26 is configured to form a color image. The camera 26 is located and configured to capture an image of the entirety of the top surface 14*a* of the table 14.

An overall operation of the printing device 10 is controlled by a microcomputer 300. As the microcomputer 300, a known microcomputer including, for example, a CPU, a ROM and a RAM is preferably usable. There is no specific limitation on the hardware structure of the microcomputer 300. Software is read into the microcomputer 300, and the microcomputer 300 is configured and/or programmed to define each of elements and units described below. The microcomputer 300 acts as a storage 50 that stores various types of information on, for example, an image captured by the camera 26, a position/posture acquirer 52 that acquires the position and the posture of the printing subject 200 placed on the top surface 14*a* of the table 14, and a printing data generator 54 that creates printing data actually usable for printing, based on printing data edited by an operator.

The position/posture acquirer 52 includes a location area acquirer 62 that acquires a location area in which the printing subject 200 is to be placed, a rough edge image acquirer 64 that acquires a rough edge image, which is an image of a rough contour of the printing subject 200, a precise edge image acquirer 66 that acquires a precise edge image, which is an image of an accurate contour of the printing subject 200, a location position acquirer 68 that acquires the position and the posture of the printing subject 200, and a calculator 70 that calculates a transform matrix usable to normalize the printing subject 200 such that the printing subject 200 assumes a predetermined posture.

Before performing printing on the printing subject 200, the printing device 10 performs calibration on the camera 26 itself (hereinafter, referred to as "camera calibration") and calibration on the basis of the top surface 14*a* (printing coordinate system) of the table 14 (hereinafter, referred to as "installation calibration"). The calibrations are performed at a predetermined timing, for example, at the time of shipping of the printing device 10 from the plant or at the time of exchange of the camera 26. The camera calibration may be performed by use of an LCD (Liquid Crystal Display; not shown) or the like. After the camera calibration is performed, the camera 26 is set in the printing device 10. The installation calibration is performed to determine the relationship between the camera 26 and the top surface 14*a* of the table 14 regarding the position and the posture thereof.

This will be described more specifically. In the camera calibration, an image of a checkered pattern is captured in the entirety of the angle of view of the camera 26, and a camera parameter is calculated by use of the Zhang technique. Used as the checkered pattern is not the checkered pattern drawn on the top surface 14*a* of the table 14, but is a checkered pattern displayed on the LCD. The method for calculating the camera parameter by use of the Zhang technique is known and will not be described in detail. For example, a method disclosed in Japanese Laid-Open Patent Publication No. 2007-309660 is usable.

For using the printing device 10, only inside parameters (A) of the camera that includes lens distortion coefficients (k1, k2), which are obtained from the following expressions (1) and (2) calculated by the Zhang technique.

Expression 1

$$s\tilde{m} = A[R\ T]\tilde{M} \tag{1}$$

Expression 2

$$\begin{cases} \breve{u} = u + (u - u_0)\left[k_1(x^2 + y^2) + k_2(x^2 + y^2)^2\right] \\ \breve{v} = v + (v - v_0)\left[k_1(x^2 + y^2) + k_2(x^2 + y^2)^2\right] \end{cases} \tag{2}$$

In the installation calibration, projection transform matrix $H_{c2p}$ from a camera-captured image to a printing area image is calculated.

First, an image of the table 14 having nothing placed thereon is captured. The table has a checkered pattern having a known square pitch drawn thereon. The checkered pattern is printed by the printing head 20.

Next, the above expression (2) is used to correct the lens distortion of the captured image (i.e., image of the checkered pattern drawn on the table 14).

Then, coordinates of checker intersections are estimated at a sub pixel precision.

The square pitch is transformed into the number of pixels as the printer resolution (see FIG. 2), and a projection transform matrix $H_{c2p}$ usable to transform the coordinates of checker intersections into the pixel coordinates is determined.

Expression 3

$$s\begin{bmatrix} x_p \\ y_p \\ 1 \end{bmatrix} = H_{c2p}\begin{bmatrix} x_c \\ y_c \\ 1 \end{bmatrix},\ H_{c2p} = \begin{bmatrix} h_{11} & h_{12} & h_{13} \\ h_{21} & h_{22} & h_{23} \\ h_{31} & h_{32} & h_{33} \end{bmatrix} \tag{3}$$

Where the size of one square of the checkered pattern is n (mm) and the printer resolution is r (dpi), the number of pixels included in each square after the transform is r×n/25.4.

Then, n number of groups of coordinate values in the image before and after the transform are applied to the above expression (3).

$$\begin{cases} sx_{pn} = h_{11}x_{cn} + h_{12}y_{cn} + h_{13} \\ sy_{pn} = h_{21}x_{cn} + h_{22}y_{cn} + h_{23} \\ s = h_{31}x_{cn} + h_{32}y_{cn} + h_{33} \end{cases} \quad \text{Expression 4}$$

$$\begin{cases} h_{11}x_{cn} + h_{12}y_{cn} + h_{13} - h_{31}x_{cn}x_{pn} - h_{32}y_{cn}x_{pn} - h_{33}x_{pn} = 0 \\ h_{21}x_{cn} + h_{22}y_{cn} + h_{23} - h_{31}x_{cn}y_{pn} - h_{32}y_{cn}y_{pn} - h_{33}y_{pn} = 0 \end{cases} \quad \text{Expression 5}$$

$$\begin{bmatrix} x_{c1} & y_{c1} & 1 & 0 & 0 & 0 & -x_{c1}x_{p1} & -y_{c1}x_{p1} & -x_{p1} \\ 0 & 0 & 0 & x_{c1} & y_{c1} & 1 & -x_{c1}y_{p1} & -y_{c1}y_{p1} & -y_{p1} \\ & & & & & \vdots & & & \\ x_{cn} & y_{cn} & 1 & 0 & 0 & 0 & -x_{cn}x_{pn} & -y_{cn}x_{pn} & -x_{pn} \\ 0 & 0 & 0 & x_{cn} & y_{cn} & 1 & -x_{cn}y_{pn} & -y_{cn}y_{cn} & -y_{pn} \end{bmatrix} \begin{bmatrix} h_{11} \\ h_{12} \\ \vdots \\ h_{32} \\ h_{33} \end{bmatrix} = \begin{bmatrix} 0 \\ 0 \\ \vdots \\ 0 \\ 0 \end{bmatrix} \quad \text{Expression 6}$$

Where B·h=0, h is determined as the right singular vector corresponding to the smallest singular value of B or as the eigenvector corresponding to the smallest eigenvalue of BTB (for example, by use of OpenCV 2.x, SVD::solveZ ( ) function).

For such calibrations for the camera 26 and the top surface 14*a* of the table 14, a conventionally known technology is usable (e.g., refer to Gang Xu, "Shashin kara tsukuru 3-jigen CG" (3D CG from Photographs) published by Kindai Kagaku Sha Co., Ltd.). Herein, a detailed description will not be provided.

Figure 3:
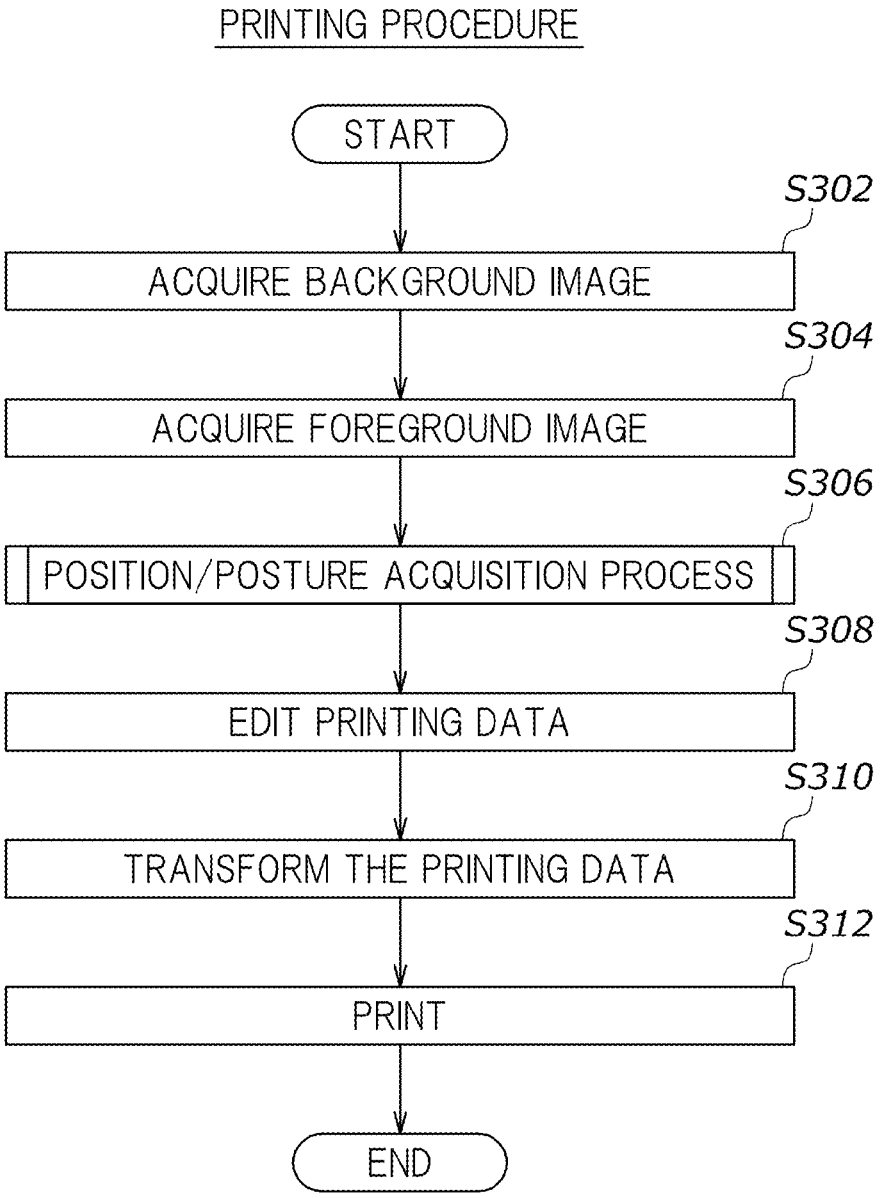
FIG. 3 is a flowchart showing a procedure of printing.

Printing by the printing device 10 is performed after the above-described calibrations are performed. Next, with reference to FIG. 3, a procedure of performing printing on the printing subject 200 will be described.

First, in a state where the movable member 18 is located just below the standing member 22 and no printing subject 200 is placed on the top surface 14*a* of the table 14, the camera 26 captures an image of the top surface 14*a* of the table 14. As a result, as shown in FIG. 5A, the image of the table 14 with no printing subject 200 being placed thereon is acquired (step S302). Hereinafter, the "image of the table 14 with no printing subject 200 being placed thereon" will be referred to as the "background image". The state where movable member 18 is located just below the standing member 22" is a state where the camera 26 is capable of capturing an image of the entirety of the top surface 14*a* of the table 14 without the movable member 18, the printing head 20 or shadows thereof being captured.

Next, the printing subjects 200 are placed on the top surface 14*a* of the table 14, and the camera 26 captures an image thereof. As a result, as shown in FIG. 5B, an image of the table 14 with the printing subjects 200 being placed thereon is acquired (step S304). Hereinafter, the "image of the table 14 with the printing subjects 200 being placed thereon" will be referred to as the "foreground image". One or a plurality of printing subjects 200 may be on the top surface 14*a* of the table 14. In the case where a plurality of printing subjects 200 are placed, the printing subjects 200 may be roughly arranged in the X-axis direction and the Y-axis direction. The printing subjects 200 thus arranged may be inclined to some extent with respect to the X-axis direction and the Y-axis direction. In the case where a plurality of printing subjects 200 are placed on the top surface 14*a*, the printing subjects 200 may be arranged so as to have a predetermined interval between adjacent printing subjects 200.

Then, an operator operates operation buttons or the like (not shown) of the printing device 10 to input an instruction to acquire the position and the posture of each of the printing subjects 200. The position/posture acquirer 52 starts a process of acquiring the position and the posture of each of the printing subjects 200, in other words, a position/posture acquisition process (step S306).

Figure 4:
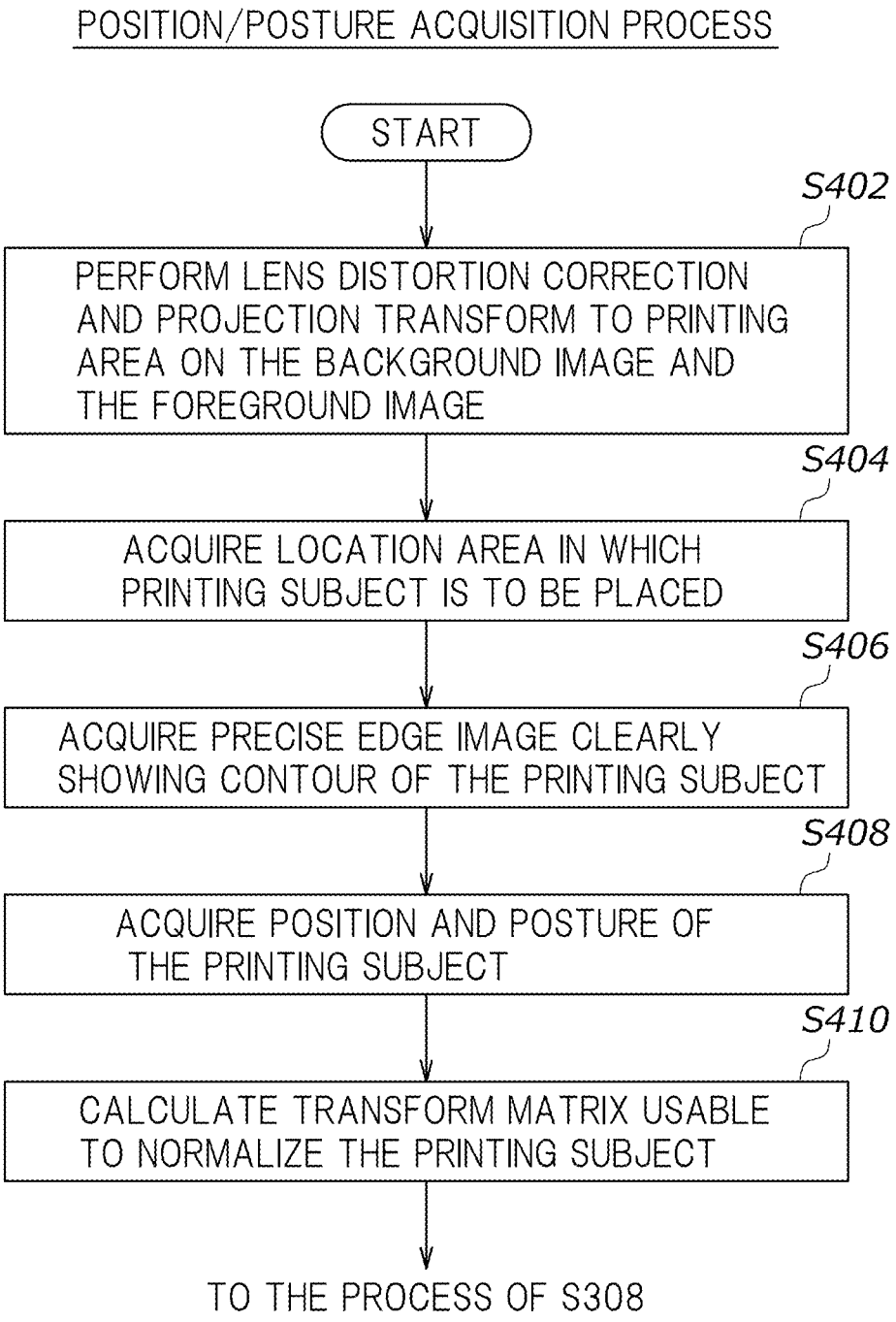
FIG. 4 is a flowchart showing detailed contents of a position/posture acquisition process.

FIG. 4 is a flowchart showing contents of the position/posture acquisition process in detail. First, the lens distortion correction is performed on the background image acquired in the process of step S302 and the foreground image acquired in the process of step S304 by use of the above expressions (2) and (3), and also the projection transform of the background image and the foreground image to the printing area is performed (step S402). FIG. 5C shows the background image obtained by the lens distortion correction and the projection transform to the printing area. FIG. 5D shows the foreground image obtained by the lens distortion correction and the projection transform to the printing area. In the following description, the "background image" refers to a background image obtained by the lens distortion correction and the projection transform to the printing area, and the "foreground image" refers to a foreground image obtained by the lens distortion correction and the projection transform to the printing area, unless otherwise specified.

Next, in step S404, the location area for the printing subjects 200 on the top surface 14*a* of the table 14 is acquired. Hereinafter, the "location area for the printing subjects 200" will be referred to simply as the "location area".

Figure 6A:
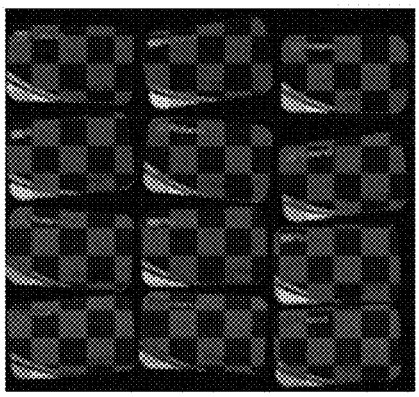
FIG. 6A shows a gray scale image acquired based on a difference between the background image and the foreground image acquired by the above-described correction and the like, FIG. 6B shows a differential binary image acquired by binarizing the gray scale image shown in FIG. 6A.

In the process of step S404, the location area acquirer 62 determines a difference between the background image and the foreground image. This will be described in more detail. The location area acquirer 62 creates a gray scale image represented with gray values from the background image and the foreground image, which are both a color image, based on Euclid distances between corresponding pixels of the two images by use of RGB as a vector (see FIG. 6A). Such a technology of extracting the difference between a background image and a foreground image to create a gray scale image is conventionally known and will not be described in detail herein.

Figure 6B:
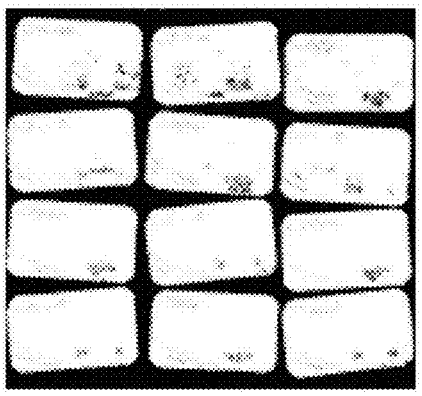
Figure 6C:
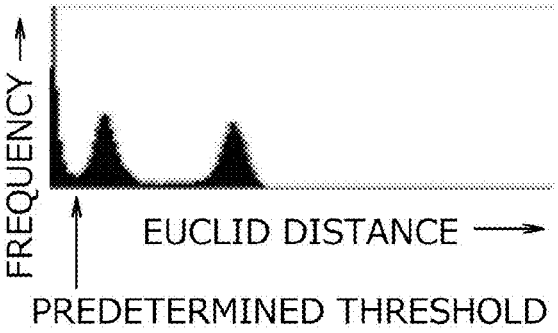
FIG. 6C shows a histogram of Euclid distance values.

Then, the location area acquirer 62 binarizes the created gray scale image in order to clarify areas where the printing subjects 200 are present and an area where no printing subject 200 is present (see FIG. 6B). More specifically, the location area acquirer 62 creates a differential binary image in which the gray values larger than or equal to a predetermined threshold are "white" and the gray values smaller than the predetermined threshold is "black". In a histogram of Euclid distances (see FIG. 6C), the foot to the right of the lowest of the mountains along the axis representing the Euclid distance is set to the predetermined threshold. As a result, the differential binary image (first binary image) as shown in FIG. 6B is acquired.

Figure 6D:
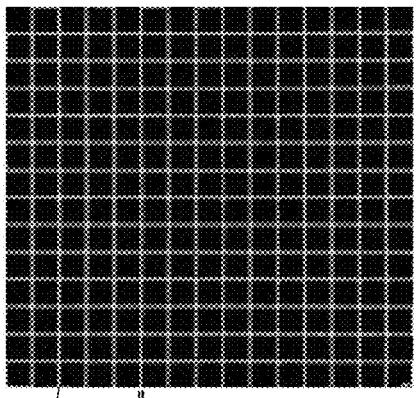

The location area acquirer 62 performs a Sobel filtering process on the background image and then performs a binarization process by use of the Otsu's threshold to create a background binary image (second binary image) clearly showing borderlines between squares in the checkered patterns (see FIG. 6D). The Sobel filtering process and the "binarization by use of the Otsu's threshold" are conventionally known and will not be described in detail.

Figure 7A:
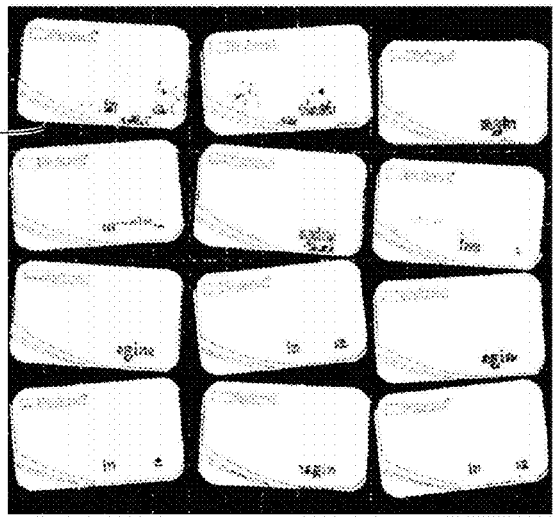
FIG. 7A is an absolute differential image acquired by synthesizing the differential binary image and the background binary image.

Then, the location area acquirer 62 synthesizes the differential binary image (image shown in FIG. 6B) created by use of the difference between the background image and the foreground image, and the background binary image (image shown in FIG. 6D) clearly showing the borderlines between the squares in the checkered pattern to acquire an absolute differential image shown in FIG. 7A.

Figure 7B:
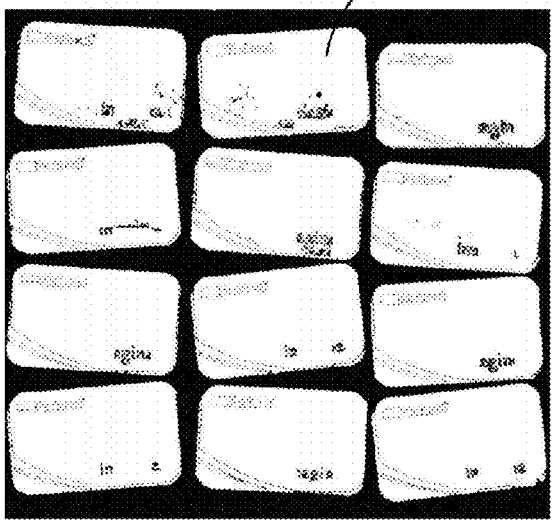
FIG. 7B shows an absolution differential image deprived of noise.

There are cases where in the absolute differential image shown in FIG. 7A, noise (white pixels) caused by the borderlines between the squares may remain in an area where no printing subject 200 is placed (i.e., area represented by "black"). In the next step, in order to remove the noise, the location area acquirer 62 scans the white pixels on the absolute differential image in upward, downward, leftward and rightward directions, and changes an area of continuous white pixels, that has a length smaller than or equal to the width of the borderlines in the background binary image (see FIG. 6D), into black pixels (see FIG. 7B).

Figure 7C:
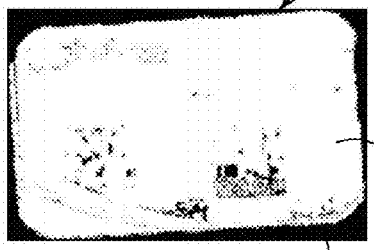
FIG. 7C shows a location area for a printing subject.

Then, from the absolute differential image deprived of the noise caused by the borderlines between the squares (see FIG. 7B), the location area acquirer 62 extracts a point group of continuous white pixels as one printing subject 200, and acquires a bounding box enclosing the point group (see FIG. 7C). The location area acquirer 62 acquires a combination of the point group of continuous white pixels and the bounding box as the location area for the printing subject 200.

Such acquisition of the location area for the printing subject 200 is performed for all the printing subjects 200 placed on the top surface 14*a* of the table 14. In this example, 12 location areas are acquired from the absolute differential image shown in FIG. 7B. After the location areas for the printing subjects 200 are acquired in the above-described manner, a process of acquiring, in each location area, a precise edge image clearly showing an accurate contour of the printing subject 200 is performed (step S406).

Figure 8A:
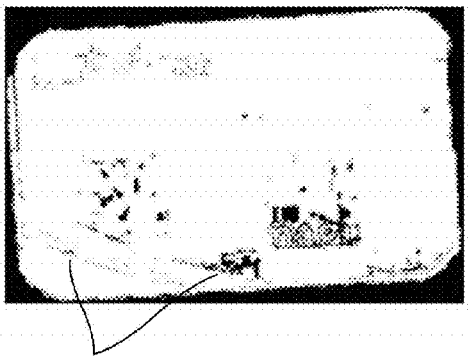
FIG. 8A shows the location area in a state where a bounding box thereof is expanded.

The process of step S406 is performed as follows. First, the rough edge image acquirer 64 expands the acquired bounding box enclosing the printing subject 200 by three pixels along each of four sides thereof in an arbitrary location area, and sets the location area for the printing subject 200 that includes the post-extension bounding box as an ROI (Region of Interest) of the printing subject 200 (see FIG. 8A).

Figure 8B:
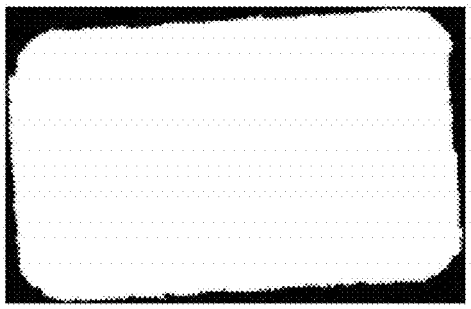
FIG. 8B shows the location area with the expanded bounding box, in a state where black pixels in a point group of white pixels have been removed.

Next, the rough edge image acquirer 64 performs a process of enlarging and then contracting the white pixels in the ROI a plurality of times, and newly generates an image in which the pixels in an area of continuous black pixels starting from a black pixel are made black pixels and the pixel in the remaining area are made white pixels. As a result, the black pixels in the area representing the printing subject 200 are removed (see FIG. 8B).

Figure 8C:
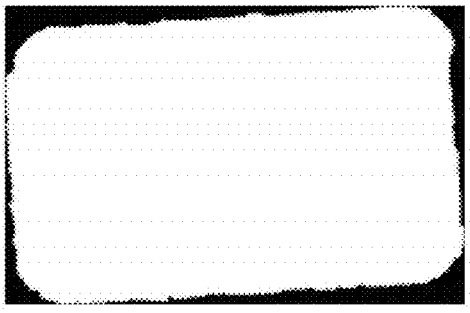
FIG. 8C shows an expanded image acquired by expanding the point group of white pixels from which the black pixels have been removed.

Then, the rough edge image acquirer 64 enlarges the white pixels located at the border between the black pixels and the point group of continuous white pixels deprived of the black pixels. As a result, the rough edge image acquirer 64 acquires an expanded image by expanding, outward by two pixels, the area representing the printing subject 200 represented by the point group of white pixels (see FIG. 8C).

Figure 8D:
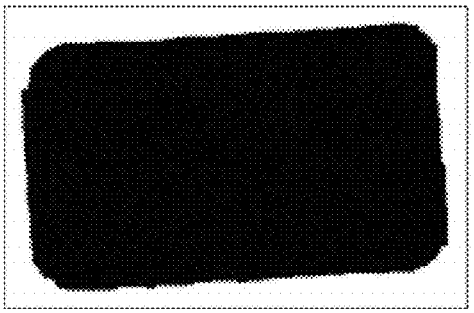
FIG. 8D shows a contracted and inverted image acquired by contracting the point group of white pixels in the expanded image and inverting the white pixels and the black pixels.

Then, the rough edge image acquirer 64 contracts, by a predetermined amount, the area representing the printing subject 200 which has been expanded by two pixels. Then, the rough edge image acquirer 64 inverts the white pixels and the black pixels inside the bounding box to acquire a contracted and inverted image (see FIG. 8D). The predetermined amount by which the area is contracted is, for example, about 2% of the length of the diagonal line of the area representing the printing subject 200 expanded by two pixels.

Figure 8E:
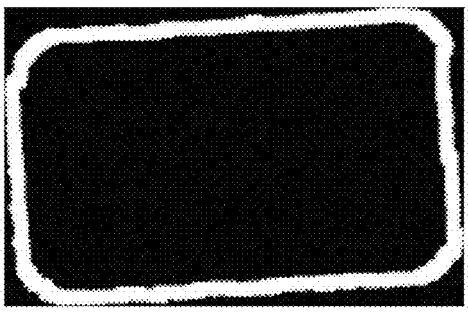
FIG. 8E shows a rough edge image acquired by synthesizing the expanded image and the contracted and inverted image.

Then, the rough edge image acquirer 64 synthesizes the acquired expanded image and the contracted and inverted image to acquire a rough edge image (first edge image) in which a rough contour (edge) of the printing subject 200 is formed (see FIG. 8E).

Figure 9A:
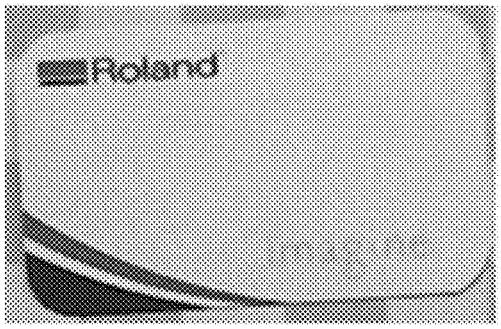
FIG. 9A shows a foreground image in an ROI (Region of Interest)
Figure 9B:
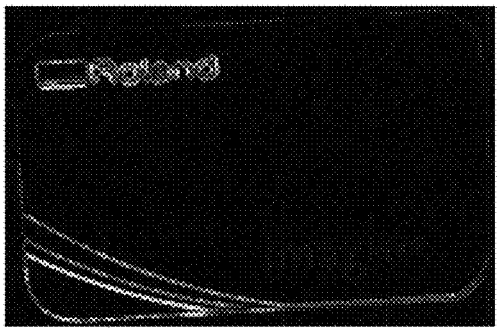
FIG. 9B shows a non-maximal suppression DoG (Difference of Gaussian) image acquired by processing the foreground image in the ROI.

After the rough edge image is acquired, the precise edge image acquirer 66 acquires the foreground image of the ROI (see FIG. 9A), and performs a process of generating a DoG (Difference of Gaussian) image and a non-maximal suppression process based on the foreground image to acquire a non-maximal suppression DoG image (see FIG. 9B). The technologies of the process of generating a DoG image (Difference of Sobel-X and Sobel Y) and the non-maximal suppression process are conventionally known and will not be described in detail.

Figure 9C:
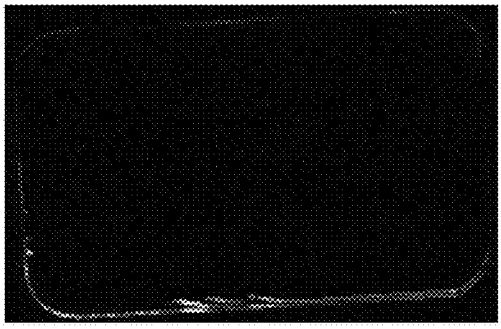
FIG. 9C shows an image acquired by synthesizing the rough edge image and the non-maximal suppression DoG image.
Figure 9D:
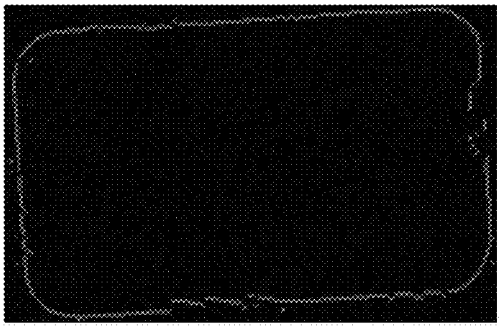
FIG. 9D shows a precise edge image acquired from the image shown in FIG. 9C, the precise edge image representing an accurate contour of the printing subject.

Then, the precise edge image acquirer 66 synthesizes the acquired non-maximal suppression DoG image and the rough edge image to remove the white pixels except for the white pixels in the vicinity of the contour of the printing subject 200 (see FIG. 9C). Then, the precise edge image acquirer 66 scans the synthesized image in the upward, downward, leftward and rightward directions from the center to leave only the white pixels first read. Thus, the precise edge image acquirer 66 acquires a precise edge image (second edge image) in which an accurate contour (edge) of the printing subject 200 is formed (see FIG. 9D).

Then, substantially the same process is performed on the location areas for which a precise edge image has not been acquired, and thus the precise edge images are acquired for all the location areas.

After the precise edge images are acquired, the position and the posture of the printing subject 200, the contour of which is displayed in the precise edge image is acquired in each location area (step S408). In the process of step S408, the location position acquirer 68 applies a straight line to each of four sides of the contour of the printing subject 200 in the precise edge image, and determines straight lines passing the four sides and intersections of these straight lines.

Figure 10A:
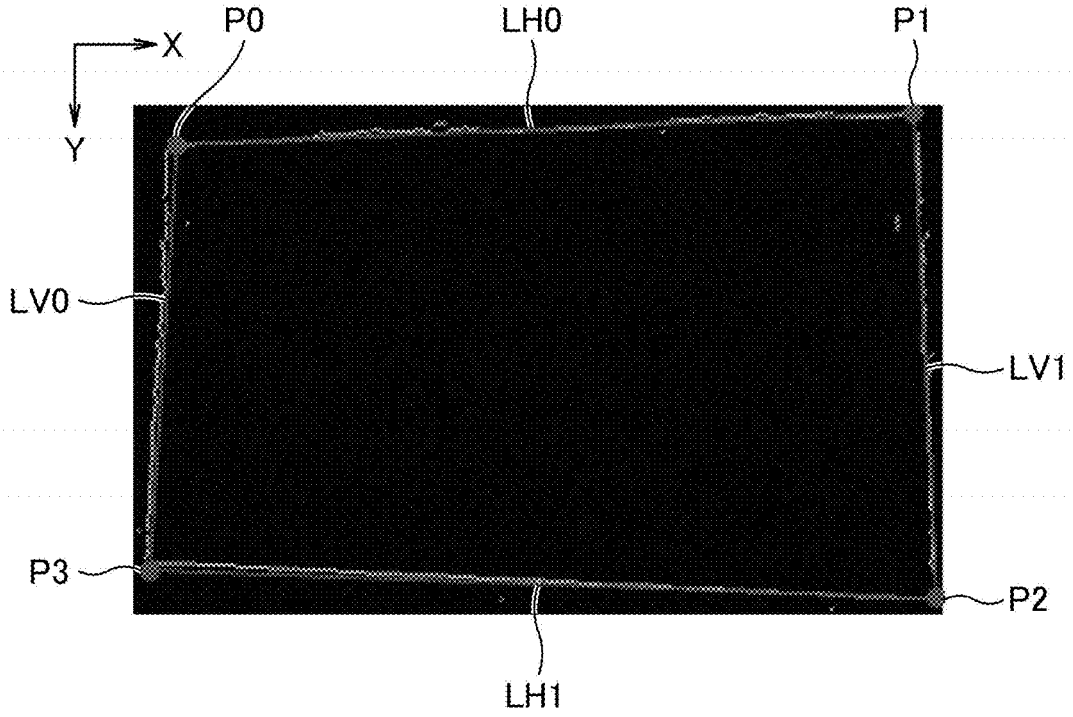
FIG. 10A shows straight lines passing four sides of the contour of the printing subject and intersections of the straight lines.

Next, a procedure of determining the straight lines passing the four sides of the contour of the printing subject 200 and the intersections of these straight lines will be described. The following description will not be given on the precise edge image acquired from the ROI mentioned above, but will be given on an image shown in FIG. 10A, more specifically, a rectangular image, the four corners of which are not of the right angle.

First, the expression on straight line $x=a1 \cdot y+b1$ is detected by the Hough transform. In this process, two straight lines having an absolute value of inclination "a1" of 1 or smaller (i.e., the inclination of each straight line with respect to the X axis is about −45 degrees or greater and about 45 degrees or smaller) are acquired. In the example shown in FIG. 10A, two straight lines extending in a horizontal or substantially horizontal direction, LH0 and LH1, are acquired. The straight line having a smaller b1 value of Y intercept is labeled as "LH0", whereas the straight line having a larger b1 value of Y intercept is labeled as "LH1". Next, the expression on straight line $y=a2 \cdot x+b2$ is detected by the Hough transform. In this process, two straight lines having an absolute value of inclination "a2" of 1 or smaller (i.e., the inclination of each straight line with respect to the Y axis is −45 degrees or greater and 45 degrees or smaller) are acquired. In the example shown in FIG. 10A, two straight lines extending in a vertical or substantially vertical direction, LV0 and LV1, are acquired. The straight line having a smaller b2 value of X intercept is labeled as "LV0", whereas the straight line having a larger b2 value of X intercept is labeled as "LV1". Then, the intersection of the straight line LH0 and the straight line LV0 is labeled as "P0", the intersection of the straight line LH0 and the straight line LV1 is labeled as "P1", the intersection of the straight line LH1 and the straight line LV1 is labeled as "P2", and the intersection of the straight line LH1 and the straight line LV0 is labeled as "P3". The coordinate values of the intersections P0, P1, P2 and P3 acquired in this process are not coordinate values in the ROI from which the precise edge image was acquired, but are coordinate values in the printing coordinate system.

In this manner, the straight lines passing the four sides of the contour of the printing subject 200 and the intersections of these straight lines are acquired in the precise edge image. As a result, the position and the posture of the printing subject 200 are acquired.

Figure 10B:
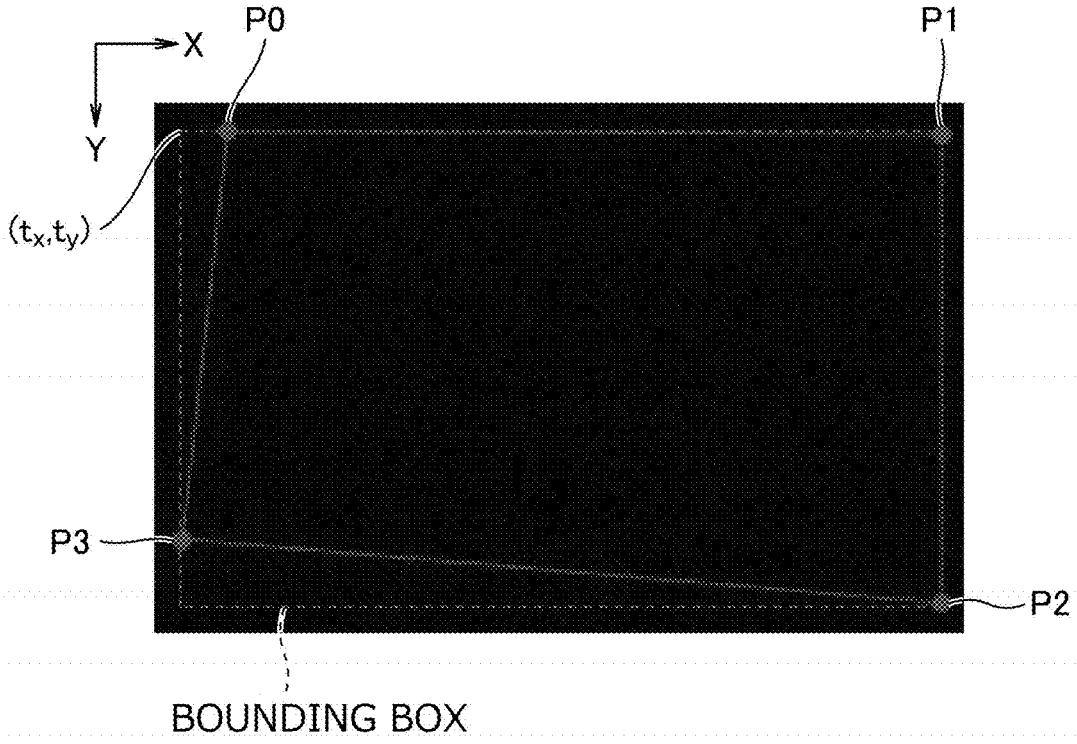
FIG. 10B shows a normalized state of the contour of the printing subject.

After the position and the posture of the printing subject 200 in each location area are acquired, a transform matrix usable to normalize the printing subject 200 such that the printing subject 200 assumes a predetermined posture in each location area is calculated (step S410). The "predetermined posture" is, for example, a posture at which the straight line LH0 is parallel to the X axis. In the process of step S410, the calculator 70 calculates a parameter by which the inclination of the bounding box enclosing the intersections P0, P1, P2 and P3 is made horizontal (see FIG. 10B) and the coordinate values in the printing coordinate system are transformed into coordinate values in a local coordinate system of the printing subject 200.

This will be described specifically. First, rotation angle θ by which the straight line LH0 is to be rotated to match the X axis is calculated. Next, an affine transform matrix R usable for rotation at the calculated rotation angle θ about the center of rotation, which is the origin (0, 0) of the printing coordinate system, is calculated.

$$R = \begin{bmatrix} \cos\theta & -\sin\theta & 0 \\ \sin\theta & \cos\theta & 0 \\ 0 & 0 & 1 \end{bmatrix} \quad \text{Expression 7}$$

Then, the coordinate values of the intersections P0, P1, P2 and P3 are rotated with the affine transform matrix R to acquire a bounding box enclosing the acquired coordinate values. Then, affine transform matrix T usable to move the coordinate values ($t_x$, $t_y$) of the top left point of the acquired bounding box to the origin (0, 0) is calculated.

$$T = \begin{bmatrix} 1 & 0 & -t_x \\ 0 & 1 & -t_y \\ 0 & 0 & 1 \end{bmatrix} \quad \text{Expression 8}$$

Then, an affine transform matrix $H_{p2c}$=T·R is set as the transform parameter from the printing coordinate system to the local coordinate system of the printing subject 200.

$$H_{p2e} = \begin{bmatrix} \cos\theta & -\sin\theta & -t_x \\ \sin\theta & \cos\theta & -t_y \\ 0 & 0 & 1 \end{bmatrix} \quad \text{Expression 9}$$

The size of the acquired bounding box is set as the size of the printing subject 200.

The position/posture acquisition process (step S306) has been described. After the position/posture acquisition process is performed in the above-described manner, the procedure advances to the process of step S308. In the process of step S308, the operator edits printing data for the normalized printing subject 200.

Figure 11A:
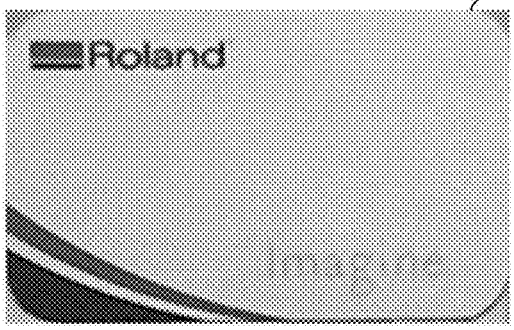
FIG. 11A shows image data of the normalized printing subject.
Figure 11B:
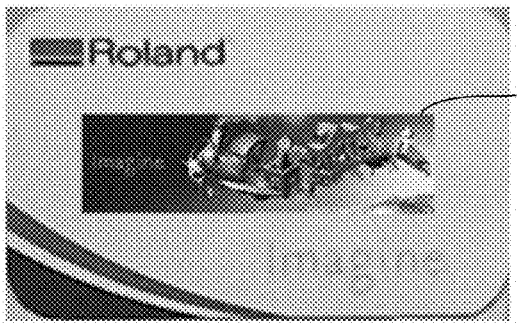
FIG. 11B shows printing data edited on image data.

In the process of step S308, the operator edits the printing data by use of editing software capable of editing printing data. In this process, editing is performed on image data of the normalized printing subject 200. The image data of the normalized printing subject 200 is acquired as follows. From the image acquired in the process of step S402 (foreground image shown in FIG. 5D), an image of one printing subject 200 is extracted, and the affine transform matrix Hp2*c* is applied to the extracted image such that the extracted image matches an area having the size of the bounding box of the corresponding printing subject 200 (size of the bounding box acquired by the process of step S410) (see FIG. 11A). The operator edits the printing data to determine what content (graphics, letters, drawings, patterns, etc.) is to be printed at which position in the printing subject 200 (see FIG. 11B).

Figure 11C:
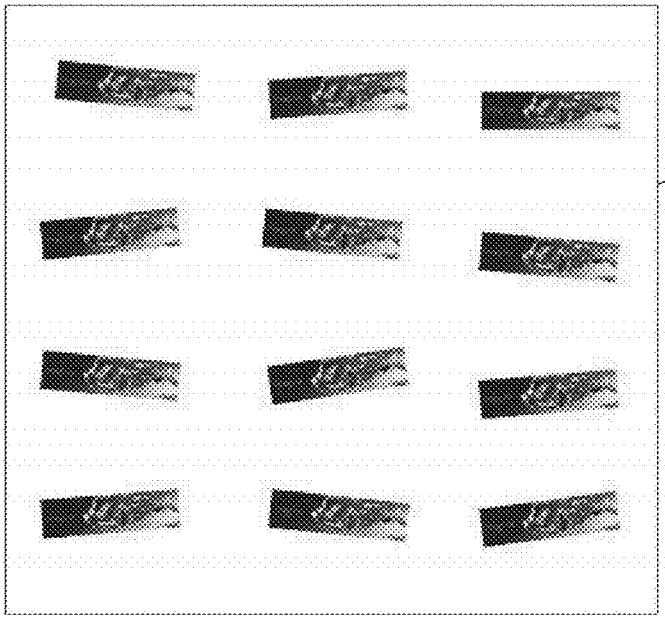
FIG. 11C shows printing data to be actually used for printing.

After the editing of the printing data by the operator is finished, the printing data generator 54 transforms the edited printing data into printing data that is printable on the pre-normalization printing subject 200 (step S310). In the process of step S310, the printing data generator 54 acquires an inverse matrix of the affine transform matrix Hp2*c* acquired for each location area in which the printing subject 200 is placed. The printing data generator 54 transforms the printing data, edited by the operator, by use of the inverse matrix. As a result, printing data in accordance with the position and the posture of each printing subject 200 (see FIG. 11C) is acquired. The printing data is stored on the storage 50 as printing data that is actually usable for printing.

After the printing data that is actually usable for printing is created by the process of step S310, the operator instructs start of printing, and then printing is performed based on the printing data under control of the microcomputer 300 (step S312). For performing printing, the microcomputer 300 moves the printing head 20 in the X-axis direction and the Y-axis direction. The microcomputer 300 causes the printing head 20 to inject ink by the inkjet system.

As described above, the printing device 10 determines a difference between a background image and a foreground image to acquire a differential binary image, acquires a background binary image from the background image, acquires an absolute differential image from the two binary images, and acquires, from the absolute differential image, a point group of white pixels representing each printing subject 200 and a bounding box enclosing the point group, the point group and the bounding box being acquired as the location area for the printing subject 200. The printing device 10 further acquires an expanded image by expanding the area of the white pixels, acquires a contracted and inverted image by contracting the area of the white pixels and then inverting the white pixels and the black pixels, and acquires a rough edge image by synthesizing these two images. The printing device 10 acquires a non-maximal suppression DoG image from the foreground image corresponding to each location area, and acquires a precise edge image from the non-maximal suppression DoG image and the rough edge image. The printing device 10 also applies straight lines to the four sides of the contour of the printing subject 200 in the precise edge image to acquire the position and the posture of the printing subject 200. Then, the printing device 10 calculates a transform matrix usable to normalize the printing subject 200. When printing data is edited by an operator, the printing device 10 transforms the printing data by use of an inverse matrix of the transform matrix to create printing data that is actually usable for printing.

Hence, the printing device 10 acquires the position and the posture of the printing subject 200 based on two images, i.e., a background image and a foreground image. The printing device 10 performs printing stably at a desired position in the printing subject 200 with no use of a jig that secures and positions the printing subject 200.

The above-described preferred embodiments may be modified as described in modified preferred embodiments (1) through (4) below.

(1) In the above-described preferred embodiments, the printing device 10 preferably is an inkjet printer. The present invention is not limited to this. The printing device 10 may be a dot impact printer, a laser printer or the like.

Figure 12:
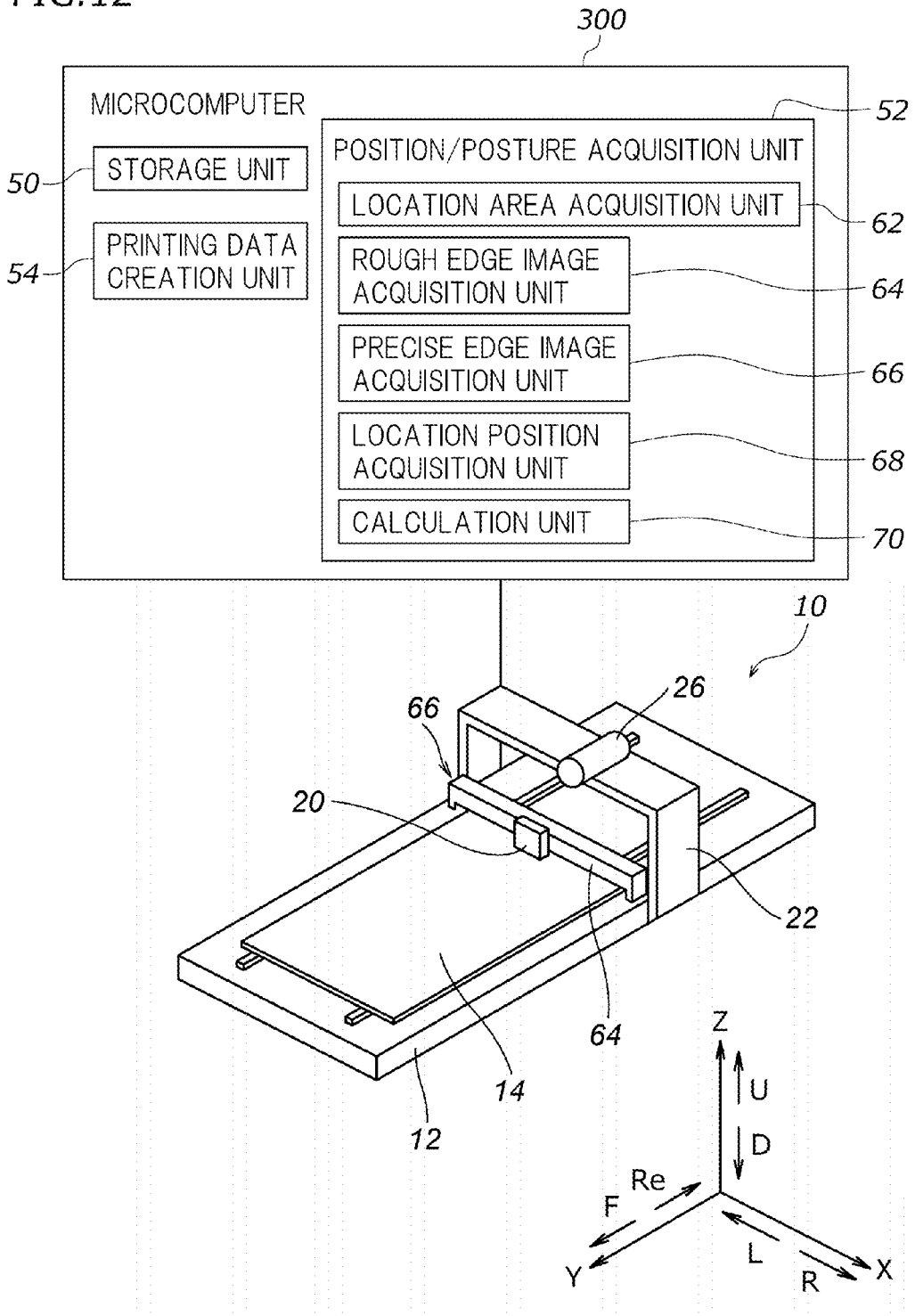
FIG. 12 shows a schematic structure of a modification of the printing device according to a preferred embodiment of the present invention.

(2) In the above-described preferred embodiments, printing preferably is performed on 12 printing subjects 200. The number of the printing subjects 200 on which printing can be performed is not limited to this. The number of the printing subjects 200 may be any of one through 11, or may be 13 or greater, (3) In the above-described preferred embodiments, the printing head 20 preferably is located on the movable member 18 movable in the Y-axis direction and is movable in the X-axis direction. The present invention is not limited to this. As shown in FIG. 12, the printing device may include a table 14 movable in the Y-axis direction and a printing head 20 movable in the X-axis direction. In the printing device shown in FIG. 12, unlike in the printing device 10, the table 14 is provided so as to be slidable with respect to guide rails 62A located on the base member 12, and the printing head 20 is provided on a secured member 66 so as to be slidable with respect to the secured member 66, which is located unmovably on the base member 12.

The printing head 20 may be movable with respect to the Y-axis direction, whereas the table 14 may be movable with respect to the X-axis direction. Alternatively, the printing head 20 may be located unmovably, whereas the table 14 may be movable with respect to the X-axis direction and the Y-axis direction.

(4) The above-described preferred embodiments and modifications described in (1) through (3) may be optionally combined.

The printing subject is not limited to a rectangular or substantially rectangular business card or greeting card, and may be any other rectangular or substantially rectangular storage medium. The printing subject may be formed of any material with no limitation, for example, paper, synthetic resin, metal, wood or the like.

The terms and expressions used herein are for description only and are not to be interpreted in a limited sense. These terms and expressions should be recognized as not excluding any equivalents to the elements shown and described herein and as allowing any modification encompassed in the scope of the claims. The present invention may be embodied in many various forms. This disclosure should be regarded as providing preferred embodiments of the principle of the present invention. These preferred embodiments are provided with the understanding that they are not intended to limit the present invention to the preferred embodiments described in the specification and/or shown in the drawings. The present invention is not limited to the preferred embodiment described herein. The present invention encompasses any of preferred embodiments including equivalent elements, modifications, deletions, combinations, improvements and/or alterations which can be recognized by a person of ordinary skill in the art based on the disclosure. The elements of each claim should be interpreted broadly based on the terms used in the claim, and should not be limited to any of the preferred embodiments described in this specification or used during the prosecution of the present application.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A printing device, comprising:

a table including a top surface on which one or a plurality of printing subjects are to be placed;

a printing head located above the top surface of the table, the printing head being movable with respect to the top surface of the table in an X-axis direction and a Y-axis direction, the X-axis direction and the Y-axis direction being perpendicular or substantially perpendicular to a vertical axis;

an image capturing device that captures an image of the top surface of the table;

a location area acquirer that acquires a background image, captured by the image capturing device, of the top surface on which a checkered pattern is printed and no printing subject is placed and a foreground image, captured by the image capturing device, of the top surface on which the one or plurality of printing subjects are placed, and acquires a location area for each of the printing subjects from the background image and the foreground image;

a rough edge image acquirer that acquires a first edge image showing a rough contour of each of the printing subjects in the location area acquired by the location area acquirer;

a precise edge image acquirer that acquires, from the first edge image, a second edge image showing a precise contour of each of the printing subjects;

a location position acquirer that acquires a position and a posture of each of the printing subjects from the second edge image;

a calculator that calculates a transform matrix usable to normalize each of the printing subjects such that each of the printing subjects assumes a predetermined posture, the transform matrix being calculated based on the position and the posture of each of the printing subjects acquired by the location position acquirer; and a printing data generator that calculates an inverse matrix of the transform matrix calculated by the calculator and transforms, by use of the inverse matrix, printing data edited by an operator to create printing data actually usable for printing.

2. A printing device according to claim 1, wherein the location area acquirer is configured to acquire a first binary image by binarizing an image obtained by determining a difference between the background image and the foreground image, to acquire, from the background image, a second binary image clearly showing a borderline in the checkered pattern, to synthesize the first binary image and the second binary image to acquire a differential image, and to acquire a location area for each of the printing subjects from the differential image.

3. A printing device according to claim 2, wherein to synthesize the first binary image and the second binary image to acquire the differential image, the location area acquirer is adapted to scan white pixels in an image acquired by synthesizing the first binary image and the second binary image and to transform an area of continuous white pixels, that has a length smaller than or equal to a width of the borderline in the checkered pattern in the second binary image, into black pixels to acquire the differential image.

4. A printing device according to claim 1, wherein the rough edge image acquirer is configured to acquire an expanded image by expanding an area representing each of the printing subjects in the location area, to acquire a contracted and inverted image by contracting the area representing each of the printing subjects in the location area and then inverting a color showing the area representing each of the printing subjects and a color showing an area not representing any printing subject, and to synthesize the expanded image and the contracted and inverted image to acquire the first edge image.

5. A printing device according to claim 4, wherein before acquiring the expanded image, and after expanding the area representing each of the printing subjects in the location area of the differential image, the rough edge image acquirer is configured to perform a process of enlarging and then contracting white pixels in an ROI a plurality of times, the ROI being a location area for each of the printing subjects that includes an expanded bounding box, and to perform, on the processed image, a process by which pixels in an area of continuous black pixels starting from a black pixel are made black pixels and pixels in the remaining area are made white pixels.

6. A printing device according to claim 1, wherein the precise edge image acquirer is adapted to acquire a non-maximal suppression DoG image of the location area in the foreground image, and to synthesize the first edge image and the non-maximal suppression DoG image to acquire the second edge image.

7. A printing device according to claim 1, wherein the location position acquirer is adapted to apply straight lines respectively to four sides of the contour of each of the printing subjects in the second edge image to acquire the position and the posture of each of the printing subjects.

8. A printing device according to claim 1, wherein the printing head is an ink head that injects ink by an inkjet system.

9. A printing method performed by a printing device, the printing device including:

a table including a top surface on which one or a plurality of printing subjects are to be placed;

a printing head located above the top surface of the table, the printing head being movable with respect to the top surface of the table in an X-axis direction and a Y-axis direction, the X-axis direction and the Y-axis direction being perpendicular or substantially perpendicular to a vertical axis; and an image capturing device that captures an image of the top surface of the table;

the method comprising:

acquiring a background image, captured by the image capturing device, of the top surface on which a checkered pattern is printed and no printing subject is placed and a foreground image, captured by the image capturing device, of the top surface on which the one or plurality of printing subjects are placed;

acquiring a location area for each of the printing subjects from the background image and the foreground image;

acquiring a first edge image showing a rough contour of each of the printing subjects in the location area;

acquiring, from the first edge image, a second edge image showing a precise contour of each of the printing subjects;

acquiring a position and a posture of each of the printing subjects from the second edge image;

calculating a transform matrix usable to normalize each of the printing subjects such that each of the printing subjects assumes a predetermined posture, the transform matrix being calculated based on the position and the posture of each of the printing subjects;

calculating an inverse matrix of the transform matrix; and transforming, by use of the inverse matrix, printing data edited by an operator to create printing data actually usable for printing.

10. A printing method according to claim 9, wherein to acquiring the location area for each of the printing subjects from the background image and the foreground image, a first binary image is acquired by binarizing an image obtained by determining a difference between the background image and the foreground image, a second binary image clearly showing a borderline in the checkered pattern is acquired from the background image, the first binary image and the second binary image are synthesized to acquire a differential image, and the location area for each of the printing subjects is acquired from the differential image.

11. A printing method according to claim 10, wherein to synthesize the first binary image and the second binary image to acquire the differential image, white pixels are scanned in an image acquired by synthesizing the first binary image and the second binary image, and an area of continuous white pixels that has a length smaller than or equal to a width of the borderline in the checkered pattern in the second binary image is transformed into black pixels to acquire the differential image.

12. A printing method according to claim 9, wherein to acquire the first edge image, an expanded image is acquired by expanding an area representing each of the printing subjects in the location area, a contracted and inverted image is acquired by contracting the area representing each of the printing subjects in the location area and then inverting a color showing the area representing each of the printing subjects and a color showing an area not representing any printing subject, and the expanded image and the contracted and inverted image are synthesized to acquire the first edge image.

13. A printing method according to claim 12, before acquiring the expanded image, and after expanding the area representing each of the printing subjects in the location area of the differential image, a process of enlarging and then contracting white pixels in an ROI is performed a plurality of times, the ROI being a location area for each of the printing subjects that includes an expanded bounding box, and a process is performed on the processed image by which pixels in an area of continuous black pixels starting from a black pixel are made black pixels and pixels in the remaining area are made white pixels.

14. A printing method according to claim 9, wherein to acquire the second edge image from the first edge image, a non-maximal suppression DoG image of the location area in the foreground image is acquired, and the first edge image and the non-maximal suppression DoG image are synthesized to acquire the second edge image.

15. A printing method according to claim 9, wherein to acquire the position and the posture of each of the printing subjects from the second edge image, straight lines are respectively applied to four sides of the contour of each of the printing subjects in the second edge image to acquire the position and the posture of each of the printing subjects.

* * * * *